US007425925B2

(12) United States Patent
Cheang et al.

(10) Patent No.: US 7,425,925 B2
(45) Date of Patent: Sep. 16, 2008

(54) VEHICLE SECURITY SYSTEM

(75) Inventors: Adam Cheang, Farmington Hills, MI (US); Nandkumar Rangnekar, Farmington Hills, MI (US); Richard Eschebach, GrossePointe Shores, MI (US)

(73) Assignee: Nissan Technical Center North America, Inc., MI (US)

( * ) Notice: Subject to any disclaimer, the term of this patent is extended or adjusted under 35 U.S.C. 154(b) by 334 days.

(21) Appl. No.: 11/362,501

(22) Filed: Feb. 27, 2006

(65) Prior Publication Data

US 2007/0200779 A1 Aug. 30, 2007

(51) Int. Cl.
*H01Q 1/32* (2006.01)

(52) U.S. Cl. ..... 343/711; 343/713

(58) Field of Classification Search ..... 343/711, 343/712, 713

See application file for complete search history.

(56) References Cited

U.S. PATENT DOCUMENTS 5,988,714 A 11/1999 Akazawa et al.
6,065,786 A * 5/2000 Wheatley ..... 293/109
6,106,039 A 8/2000 Maki
6,433,748 B1 * 8/2002 Ekelund ..... 343/713
6,522,241 B1 2/2003 Baudard
6,686,888 B1 2/2004 Wendt et al.
6,870,510 B2 * 3/2005 Raddant et al. ..... 343/711
2004/0119644 A1 6/2004 Puente-Baliarda et al.
2005/0089674 A1 4/2005 Zander et al.

FOREIGN PATENT DOCUMENTS

DE 2751356 A1 5/1979
DE 4116232 A1 11/1992
DE 19830811 A1 9/1999

* cited by examiner

*Primary Examiner*—Shih-Chao Chen
(74) *Attorney, Agent, or Firm*—Global IP Counselors

(57) ABSTRACT

A vehicle security system includes a bumper assembly, an antenna and a controller. The bumper assembly includes an energy absorbing portion and a cover portion overlying the energy absorbing portion. The antenna is supported by the energy absorbing portion and covered by the cover portion of the bumper assembly. The controller is electrically connected to the antenna to process a signal within a prescribed proximity of the antenna.

37 Claims, 11 Drawing Sheets

VEHICLE SECURITY SYSTEM

BACKGROUND OF THE INVENTION

1. Field of the Invention

The present invention generally relates to a vehicle security system. More specifically, the present invention relates to a vehicle security system that includes a concealed antenna.

2. Background Information

Security systems are increasingly becoming standard features in vehicles. Such security systems typically include a controller within the vehicle that is connected to door locking mechanisms also in the vehicle. The controller is typically configured to respond to signals transmitted within a prescribed distance around the vehicle. Typically, the signals are transmitted from a pre-programmed hand operated remote control device, such as a battery powered key fob. The pre-programmed signals from the key fob cause the controller to lock or unlock the door locking mechanisms, among other actions.

The controller is usually connected to an antenna that detects the transmitted signals and conducts the signals to the controller. Antennas are usually mounted on an exterior surface of the vehicle and protrude outwardly therefrom. With vehicles continually becoming more aerodynamic, protruding antennas are becoming less and less desirable in that they can create wind drag, thereby reducing fuel efficiency of the vehicle at high speeds. As well, protruding antennas create a design challenge when incorporating them into the overall design of a vehicle further reducing their desirability. Thus, antennas have been mounted using special mounting arrangements to conceal them from view. These special mounting arrangements usually require additional parts that increase the manufacture time and cost of producing a vehicle with such a security system.

In view of the above, it will be apparent to those skilled in the art from this disclosure that there exists a need for an improved antenna support configuration. This invention addresses this need in the art as well as other needs, which will become apparent to those skilled in the art from this disclosure.

SUMMARY OF THE INVENTION

One object of the present invention is to provide a vehicle security system in which an antenna of the vehicle security system is concealed within a component of a vehicle.

Another object of the present invention is to provide an antenna of the vehicle security system that is supported and concealed within the bumper assembly is a relatively simple and inexpensive manner.

Another object of the present invention is to provide a bumper assembly with an antenna receiving configuration that supports and conceals the antenna within the bumper assembly.

In accordance with one aspect of the present invention, a vehicle security system has a bumper assembly, an antenna and a controller. The bumper assembly includes an energy absorbing portion and a cover portion overlying the energy absorbing portion. The antenna is supported by the energy absorbing portion and covered by the cover portion of the bumper assembly. The controller is electrically connected to the antenna to process a signal within a prescribed proximity of the antenna.

In accordance with another aspect of the present invention, a vehicle bumper assembly includes an energy absorbing portion and a cover portion. The energy absorbing portion includes a channel that is dimensioned and configured to receive an antenna. The cover portion is arranged and configured to cover the energy absorbing portion and conceal the channel.

In accordance with yet another aspect of the present invention, an antenna support structure includes an energy absorbing foam member and a cover portion. The energy absorbing foam member has a channel formed on a surface thereof configured and dimensioned to receive an antenna. The cover portion is arranged and configured to cover the energy absorbing foam member and conceal the channel.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
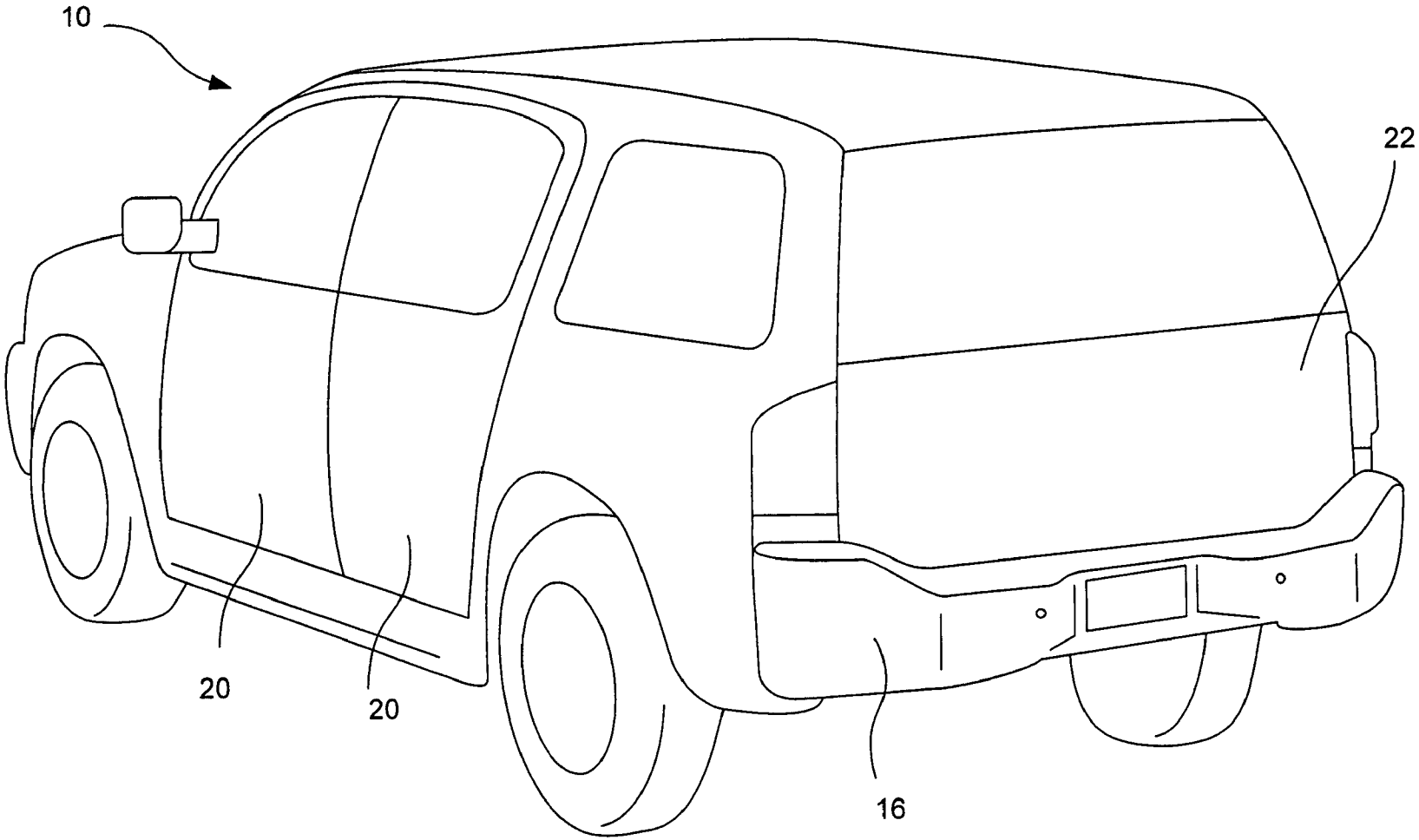
FIG. 1 is a perspective rear view of a vehicle having a security system that includes an antenna concealed within a rear bumper assembly in accordance with the present invention.
Figure 2:
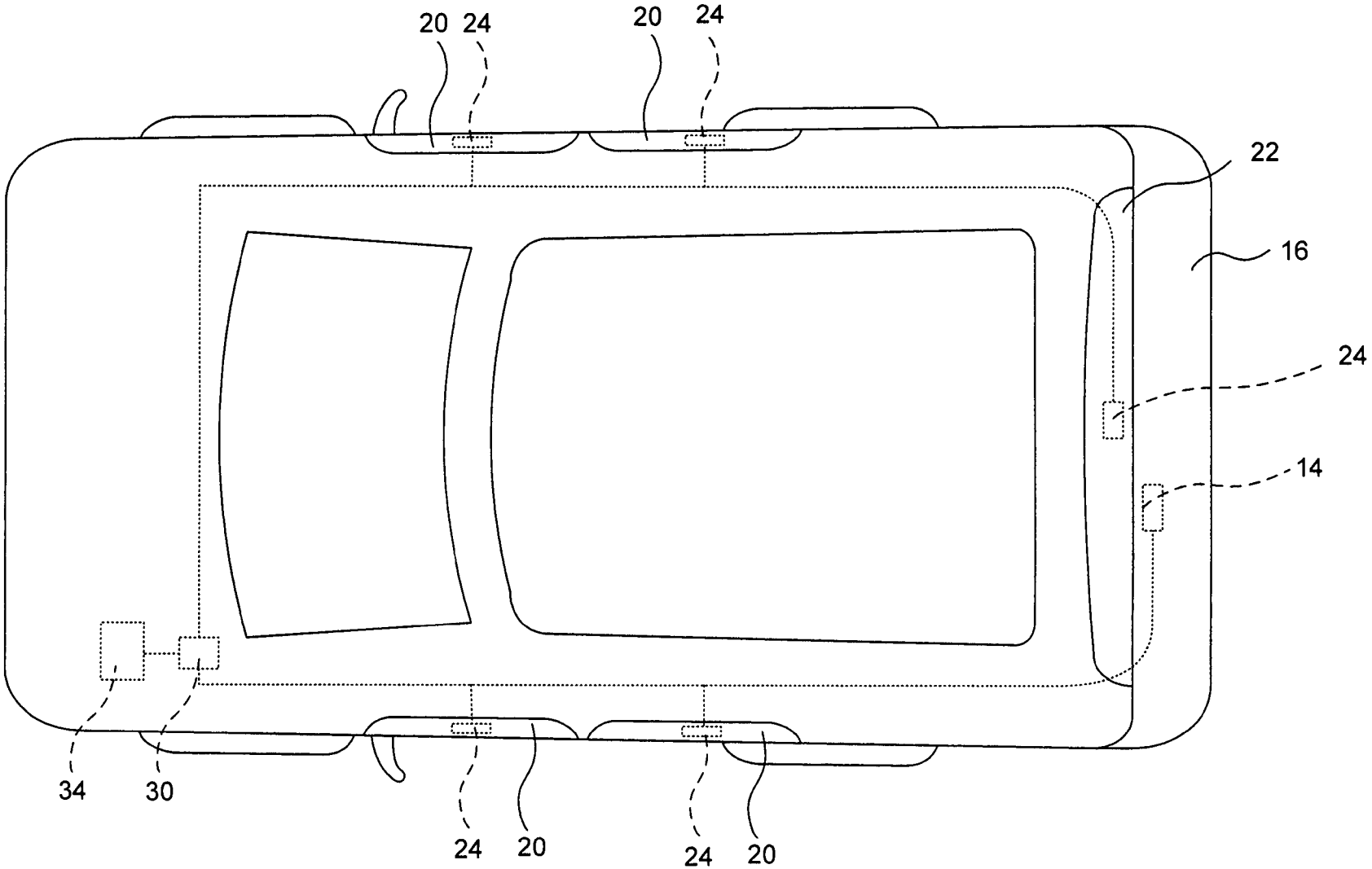
FIG. 2 is a simplified, top plan view of the vehicle depicted in FIG. 1 showing portions of the security system including a controller and the antenna in phantom in accordance with the present invention.
Figure 3:
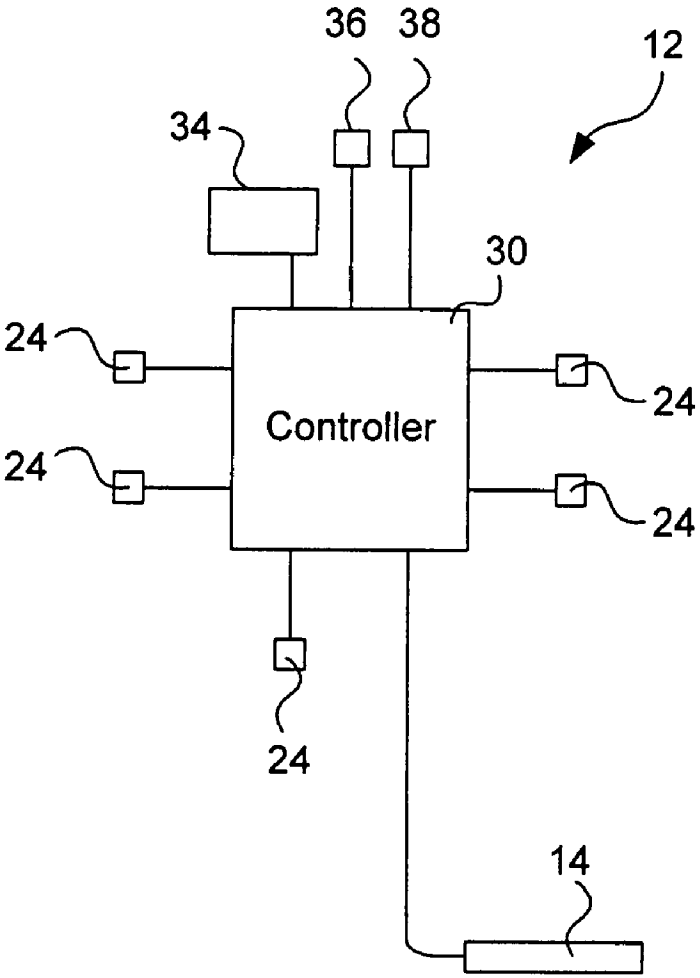
FIG. 3 is a schematic diagram showing the various portions of the security system in accordance with the present invention.

Referring initially to FIGS. 1-3, a vehicle 10 is illustrated that is equipped with a vehicle security system 12 (shown in FIGS. 2 and 3) in accordance with a first embodiment of the present invention. The vehicle security system 12 includes an antenna 14 that is concealed within a bumper assembly 16 as seen in FIG. 2.

As shown in FIGS. 1 and 2, the vehicle 10 includes, among other things, the vehicle security system 12 (FIGS. 2 and 3), a plurality of side doors 20, a rear door 22 and the bumper assembly 16. Each of the side doors 20 and the rear door 22 includes a remotely controllable locking mechanism 24. The remotely controllable locking mechanisms 24 are conventional mechanisms that lock and unlock the corresponding one of the side doors 20 or the rear door 22. Each of the remotely controllable locking mechanisms 24 are additionally connected to manually operated levers or switches (not shown) that by pass the remote operations of the remotely controllable locking mechanisms 24 such that the side doors 20 and the rear door 22 can also be manually opened, locked and unlocked.

With specific reference to FIGS. 2 and 3, a description of the vehicle security system 12 is now provided. The vehicle security system 12 basically includes a controller 30, a transmitting device 32 (FIG. 4) and the antenna 14. The controller 30 is operably connected to the remotely controllable locking mechanisms 24. In the first embodiment of the present invention, as shown in FIG. 3, the controller 30 is electrically connected to each of the remotely controllable locking mechanisms 24 in the side doors 20 and the rear door 22. The controller 30 is also electrically connected to the antenna 14 such that the signals detected by the antenna 14 are conducted to the controller 30. The controller 30 is preferably a conventional processing unit that can include a processor and/or circuitry that process signal(s) transmitted within a prescribed proximity of the antenna 14. The controller 30 is also operably connected to a power source 34 such as a battery, a horn 36, the antenna 14 and other components 38 within the vehicle 10. Specifically, the controller 30 can be programmed or configured to lock and unlock the remotely controllable locking mechanisms 24, honk the horn 36, flash the headlights (not shown), and/or start the engine, among other functions. It should be understood that the specific operations programmed into the controller 30 include a variety of functions that are caused to occur in response to receipt of a corresponding instructional signal transmitted from the transmitting device 32.

Figure 4:
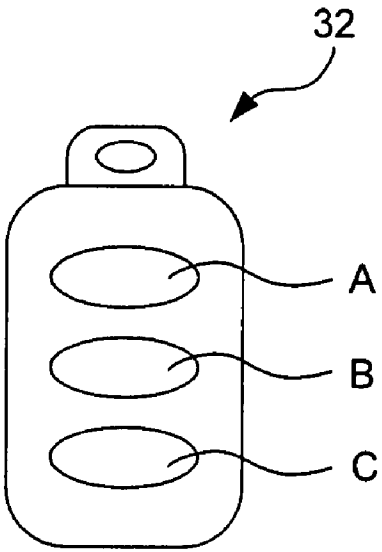
FIG. 4 is a schematic top plan view of a portable remote transmitting device configured to transmit signals to the security system in accordance with the present invention.

As shown in FIG. 4, the transmitting device 32 is a conventional mechanism that is preferably in the form of a key fob, with a loop for attachment of an ignition key (not shown) for the vehicle 10. The transmitting device 32 is preferably a small hand held device that includes several buttons, such as the buttons A, B and C. The transmitting device 32 is preferably programmed in a conventional manner such that when the first button A is pressed, a signal is transmitted to the controller 30 (via the antenna 14) to lock or unlock the remotely controllable locking mechanisms 24. The transmitting device 32 can be programmed such that pressing one of the buttons B and C causes any of a variety of actions to be taken by the controller 30, such as honking the horn 36, flashing the headlights of the vehicle 10, activate one of the other components 38, or start the engine (not shown) of the vehicle 10. The transmitting device 32, in one preferable embodiment, is configured and arranged to produce a signal that is sensed by the antenna 14 when the transmitting device 32 is located within a prescribed range of the antenna 14 such that the controller 30 automatically unlocks the doors 20 and 22 and/or allows the person with the transmitting device 32 to start the vehicle 10 without using an ignition key.

Figure 5:
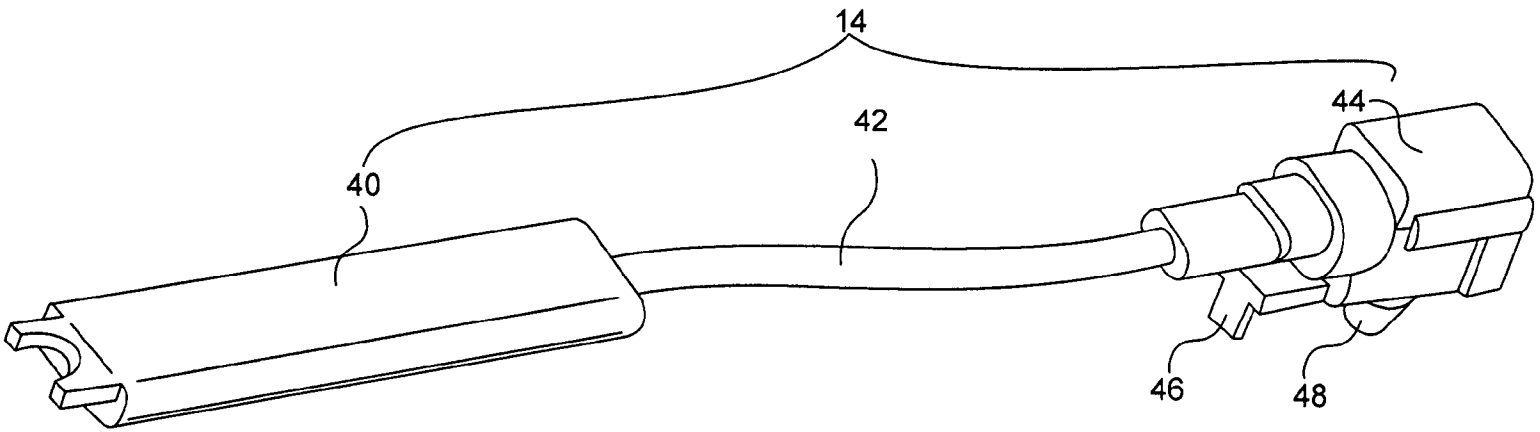
FIG. 5 is an upper side perspective view of the antenna shown removed from the vehicle and the bumper assembly in accordance with the present invention.
Figure 6:
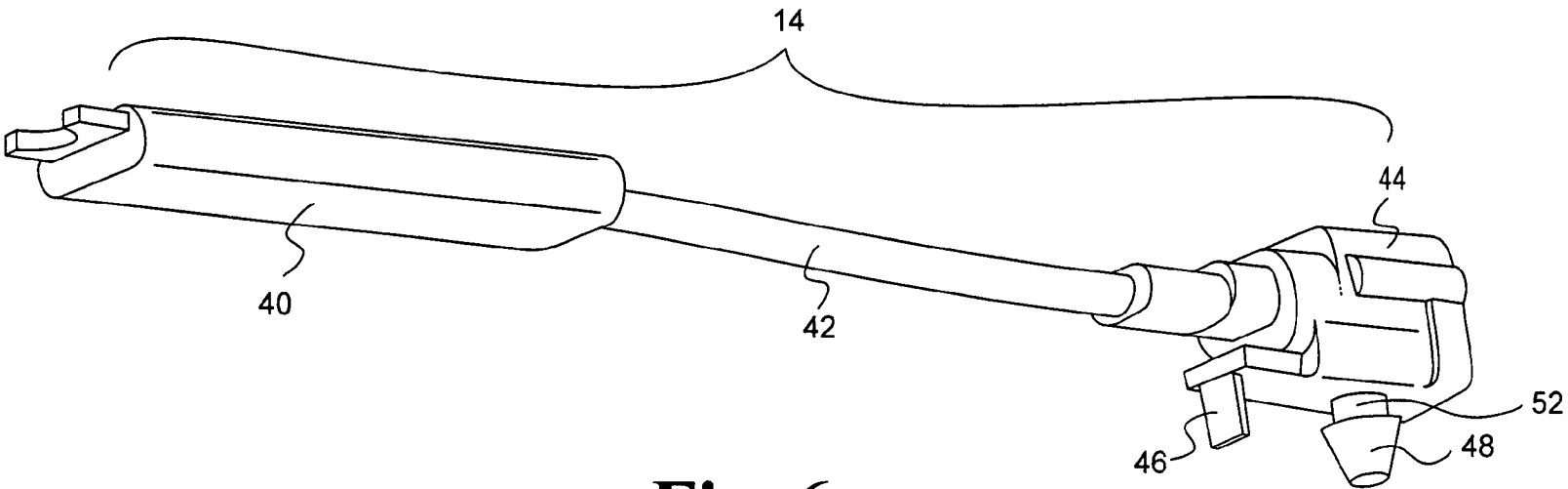
FIG. 6 is a lower side perspective view of the antenna shown removed from the vehicle and the bumper assembly in accordance with the present invention.
Figure 14:
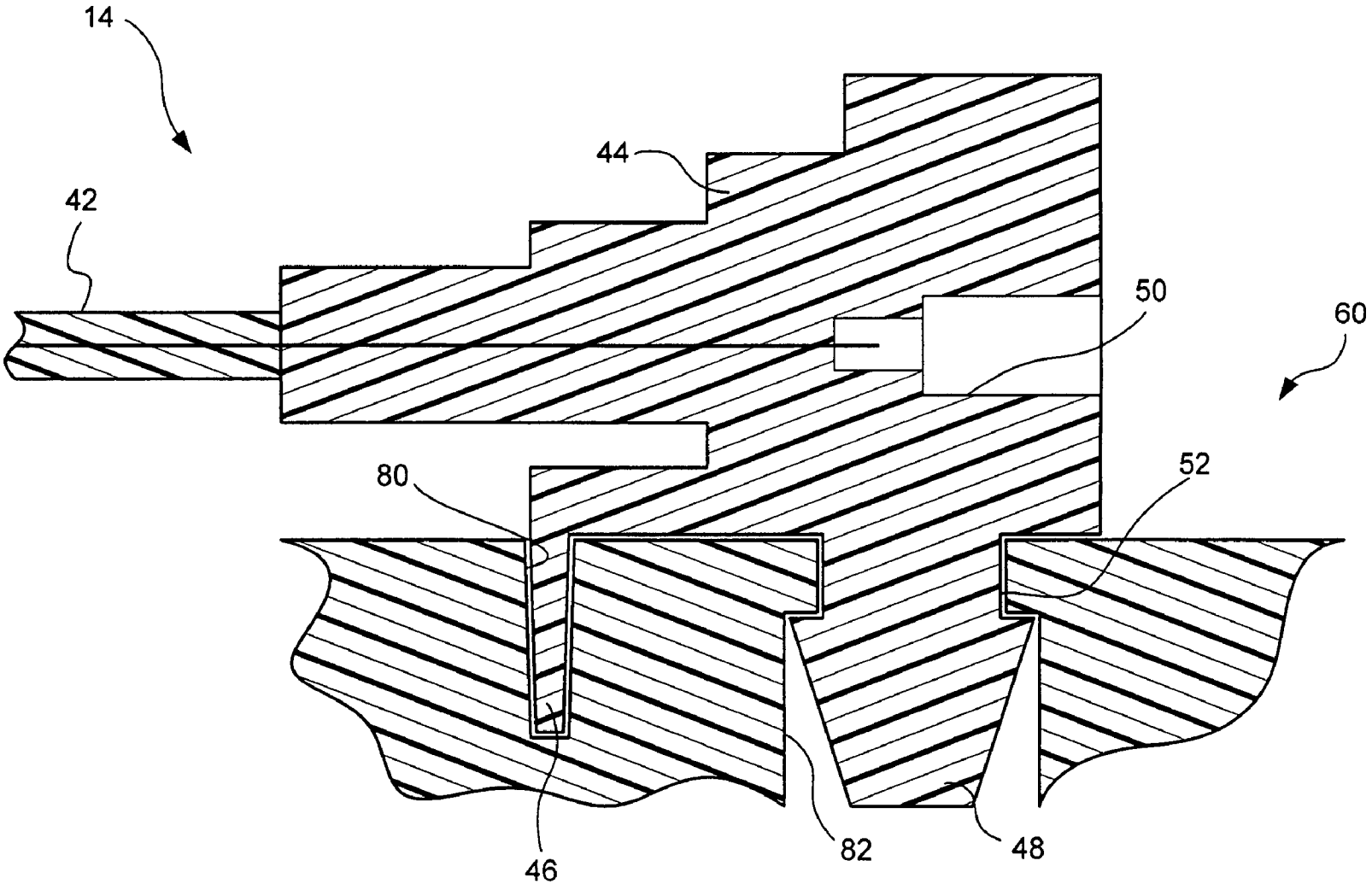
FIG. 14 is a cross-section of a portion of the energy absorbing portion showing a connector portion of the antenna secured on the energy absorbing portion in accordance with the present invention.

With specific reference to FIGS. 5 and 6, a description of the antenna 14 is now provided. The antenna 14 basically includes a body portion 40, a cable portion 42 and a connector portion 44. The body portion 40 has an elongated rectangular shape with rounded edges and is preferably fairly rigid compared to the cable portion 42, having only a small degree of flexibility. The cable portion 42 extends between the body portion 40 and the connector portion 44, and is more flexible than the body portion 40 and the connector portion 44. The connector portion 44 includes an irregular shape that includes an alignment protrusion 46, an attachment protrusion 48 and a connector plug opening 50 (FIG. 14). The aligmnent protrusion 46 has a rectangular shaped profile and the attachment protrusion 48 has a conical shape with a recess 52.

Figure 7:
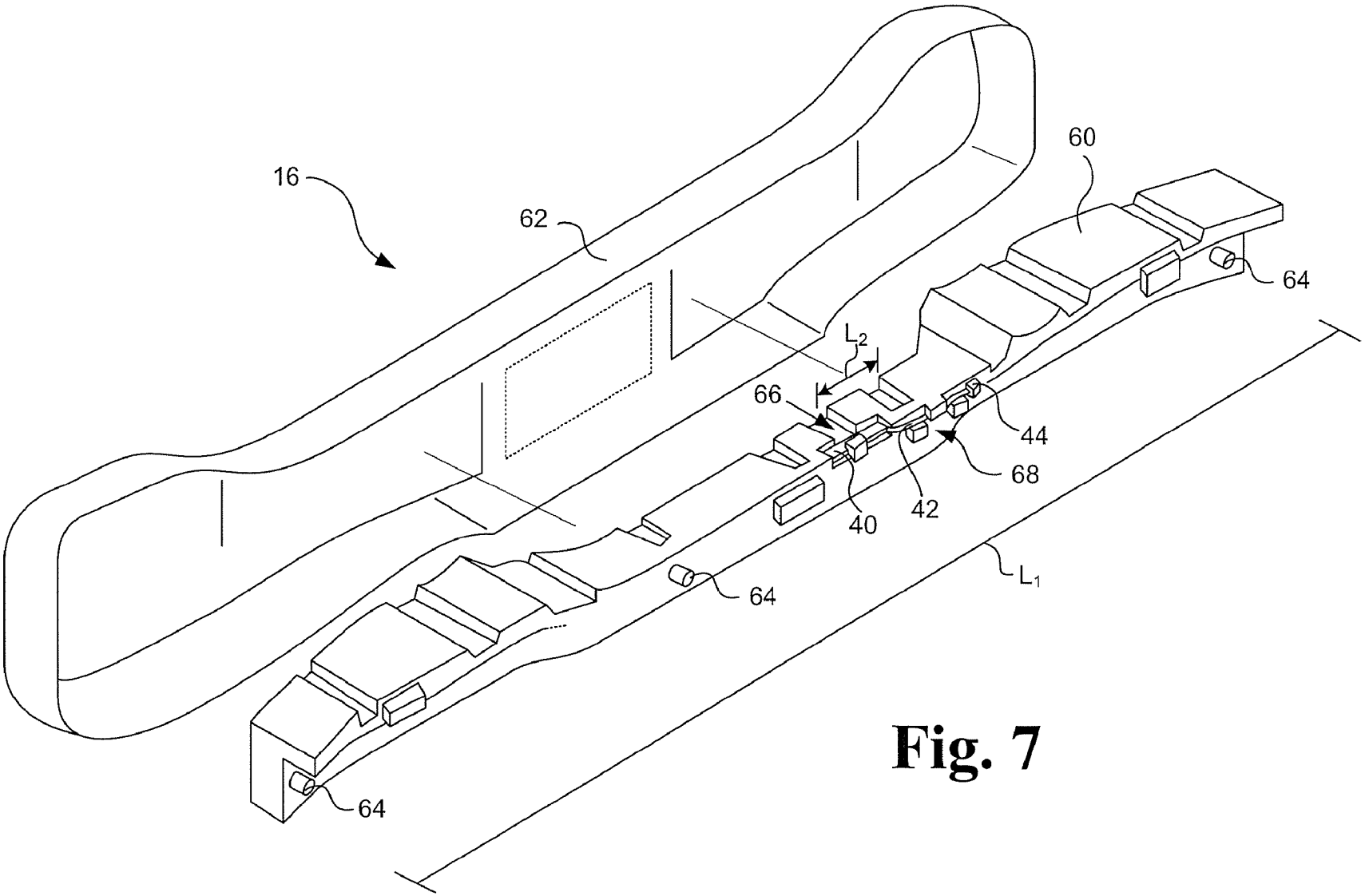
FIG. 7 is an exploded perspective view of the bumper assembly showing an energy absorbing portion and a cover portion in accordance with the present invention.
Figure 8:
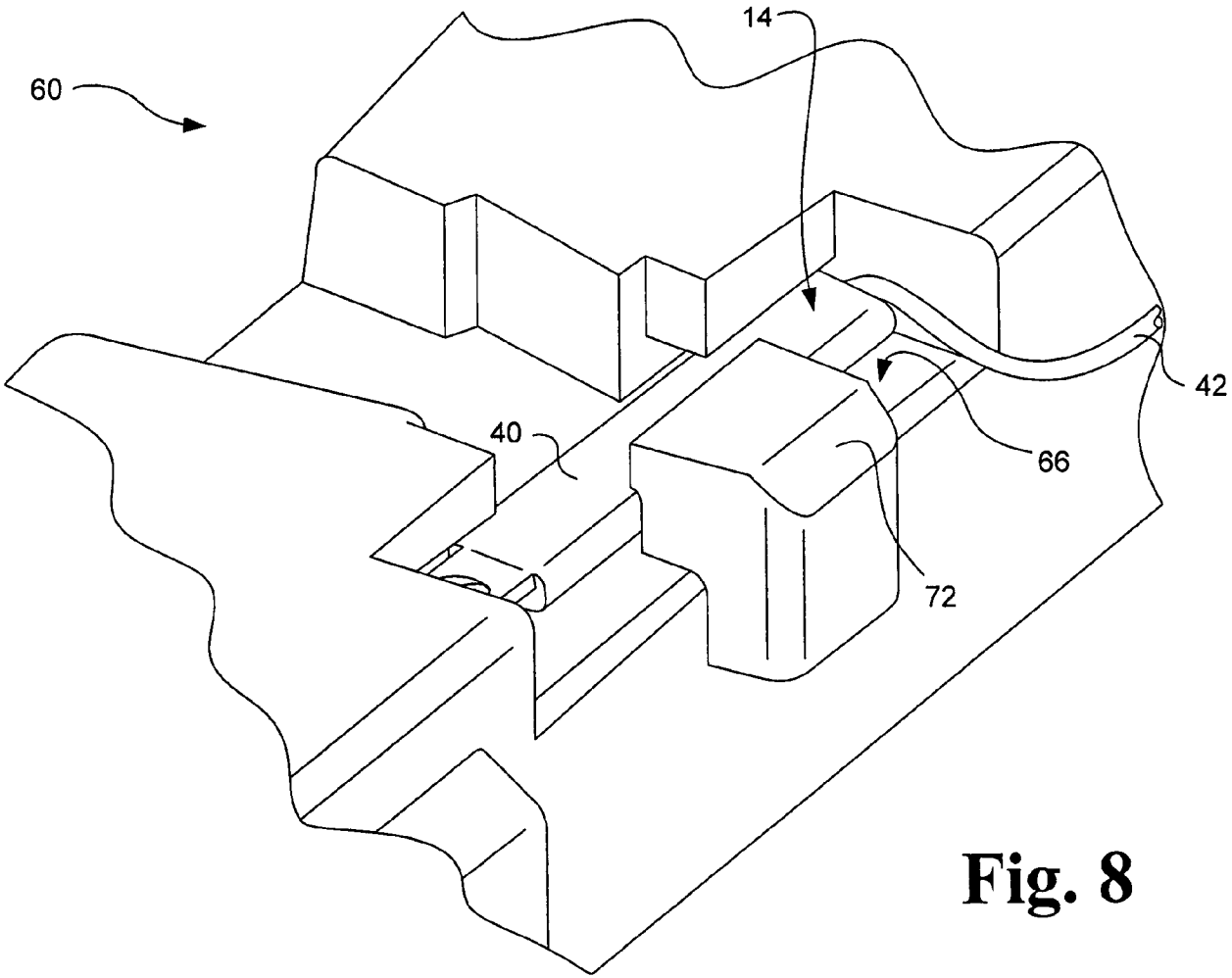
FIG. 8 is a fragmentary perspective view of the energy absorbing portion of the bumper assembly showing an antenna receiving channel formed therein in accordance with the present invention.
Figure 9:
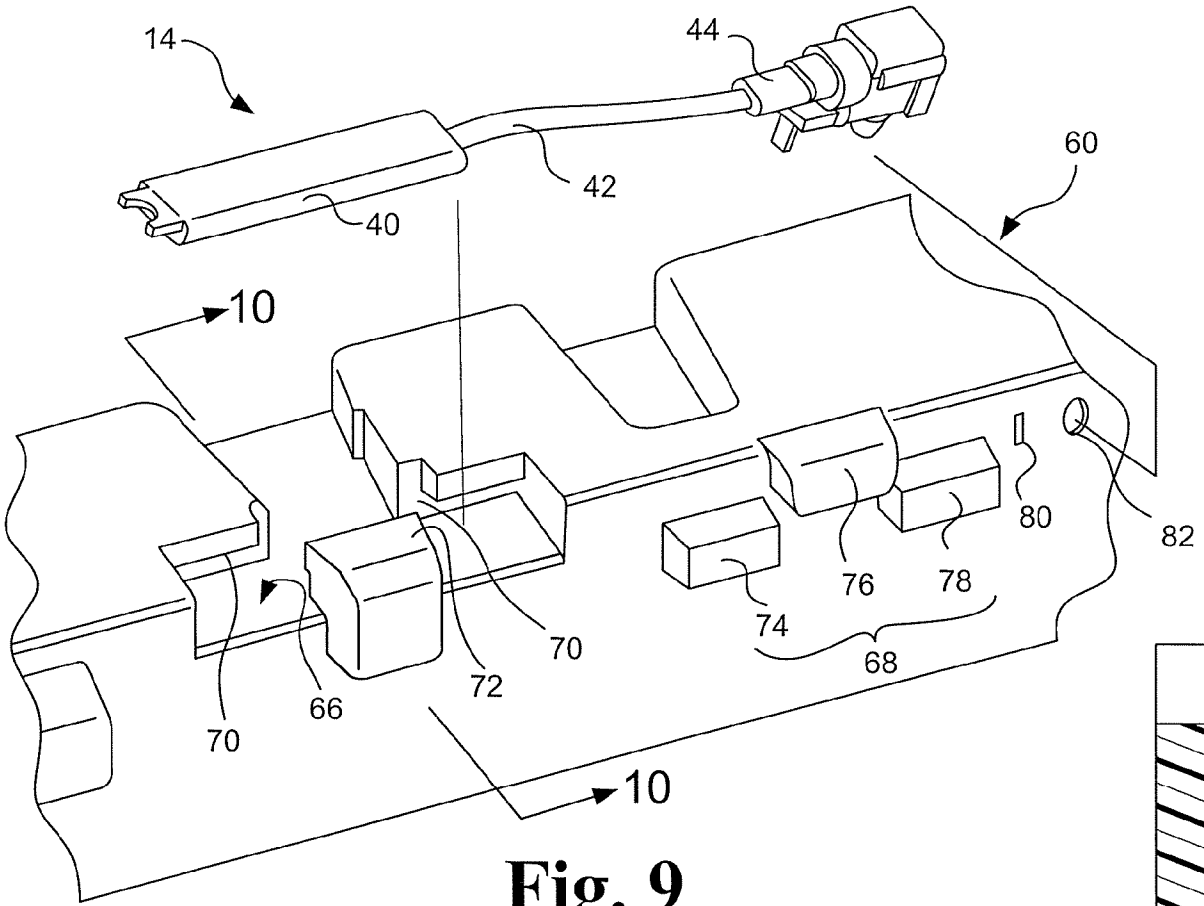
FIG. 9 is an exploded fragmentary perspective view of the energy absorbing portion of the bumper assembly showing an antenna receiving channel formed therein in accordance with the present invention.

With specific reference to FIGS. 7, 8 and 9, a description of the bumper assembly 16 is now provided. The bumper assembly 16 is an antenna support structure that basically includes an energy absorbing portion 60 and a cover portion 62. The energy absorbing portion 60 is preferably made of a molded foam material that is relatively rigid, but has sufficient resiliency to absorb low speed impacts without permanently deforming. For example, the energy absorbing portion 60 can be made of plastics, polymers, polymeric resins, rubber and/or rubber-like materials, or other materials with resilient energy absorbing characteristics and/or properties.

The energy absorbing portion 60 basically includes vehicle attachment portions 64, a channel 66 on an upper surface thereof and a cable receiving section 68 near the channel 66. Otherwise the overall shape of the energy absorbing portion 60 can vary depending upon the overall design of the vehicle 10, the impact absorbing criteria of the vehicle 10, aesthetic considerations and/or other engineering considerations. The vehicle attachment portions 64 are conventional configurations configured to attach the bumper assembly to a rear portion of the vehicle 10.

Figure 10:
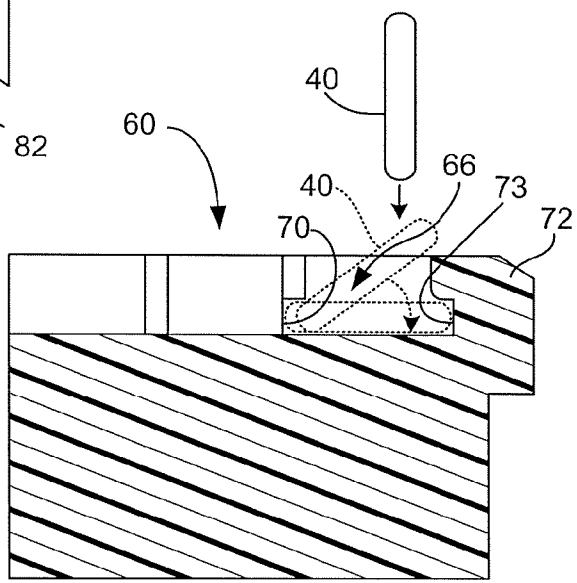
FIG. 10 is a transverse cross-section of a portion of the energy absorbing portion of the bumper assembly taken along section line 10-10 in FIG. 9 in accordance with the present invention.

The channel 66 is configured and dimensioned to receive the body portion 40 of the antenna 14 with a snap fit arrangement. Specifically, the channel 66 is at least partially defined by a pair of recesses 70 (a recessed section) and a protrusion 72. The recesses 70 are formed in the energy absorbing portion 60 adjacent to and on one side of the channel 66. As shown in FIG. 7, the energy absorbing portion 60 has an overall length $L_1$ and the channel 66 has an overall length $L_2$. The length $L_2$ is less than the length $L_1$. More specifically, the length $L_2$ is less than twenty percent of the length $L_1$. The protrusion 72 is formed on the other side of the channel 66 and includes a recess 73, as shown in FIG. 10. The protrusion 72 and the recesses 70 are located on opposite sides of the channel 66. The recesses 70 and protrusion 72 are configured and dimensioned to retain the body portion 40 of the antenna 14 within the channel 66 with a snap-fit, as described in greater detail below.

As shown in FIG. 9, the cable receiving section 68 is located adjacent to the channel 66 and includes three protrusions 74, 76 and 78 that extend from the energy absorbing member 60. The protrusions 74 and 78 are aligned with one another but spaced apart from each other and the protrusion 78. The cable receiving section 68 also includes a pair of connector openings 80 and 82. The opening 80 is rectangular in shape and the opening 82 is round.

Figure 11:
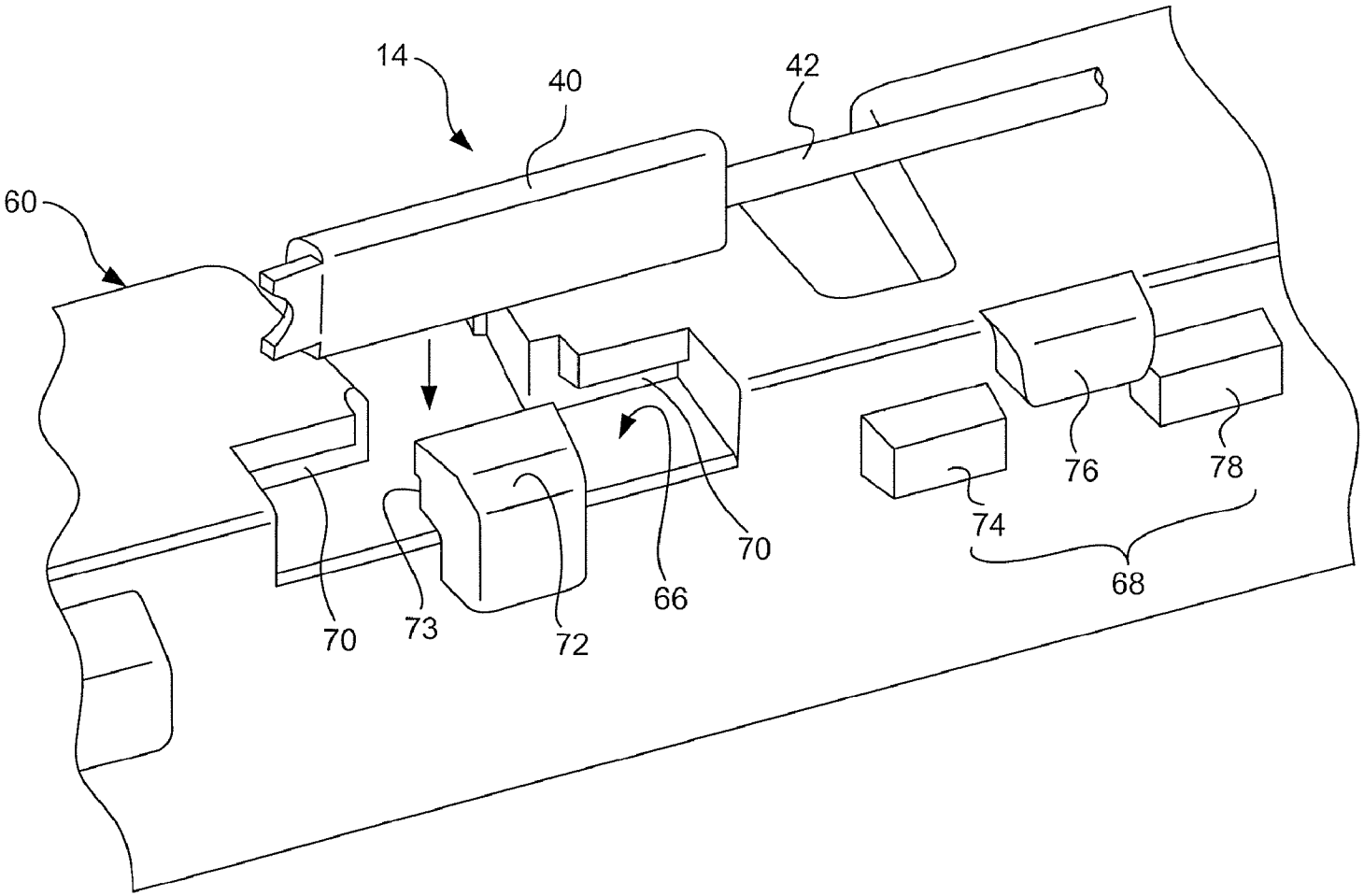
FIG. 11 is a fragmentary perspective view of the energy absorbing portion of the bumper assembly showing the antenna positioned above the antenna receiving channel ready for installation therein in accordance with the present invention.
Figure 12:
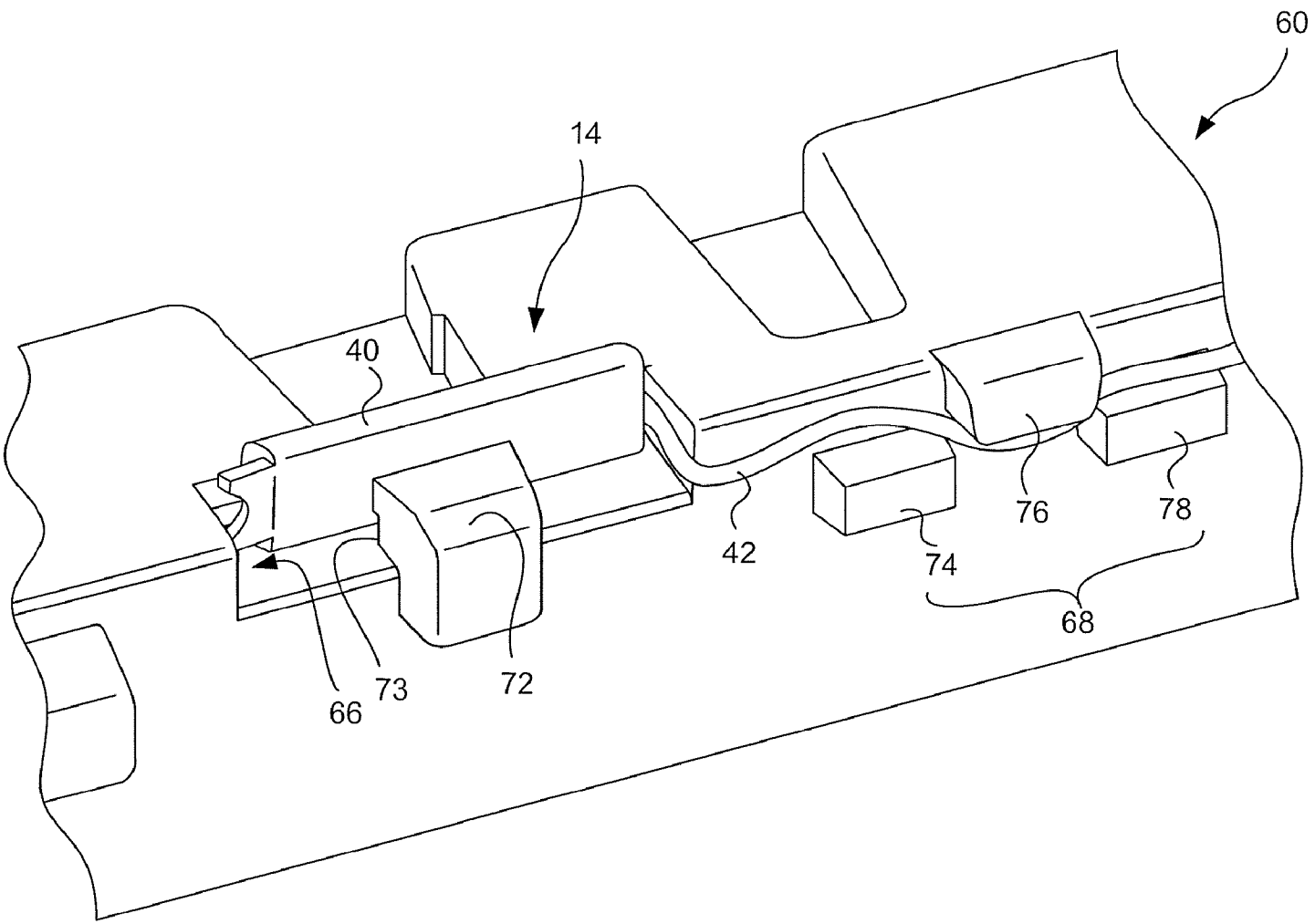
FIG. 12 is a fragmentary perspective view of the energy absorbing portion of the bumper assembly showing the antenna positioned part-way in the antenna receiving channel in accordance with the present invention.
Figure 13:
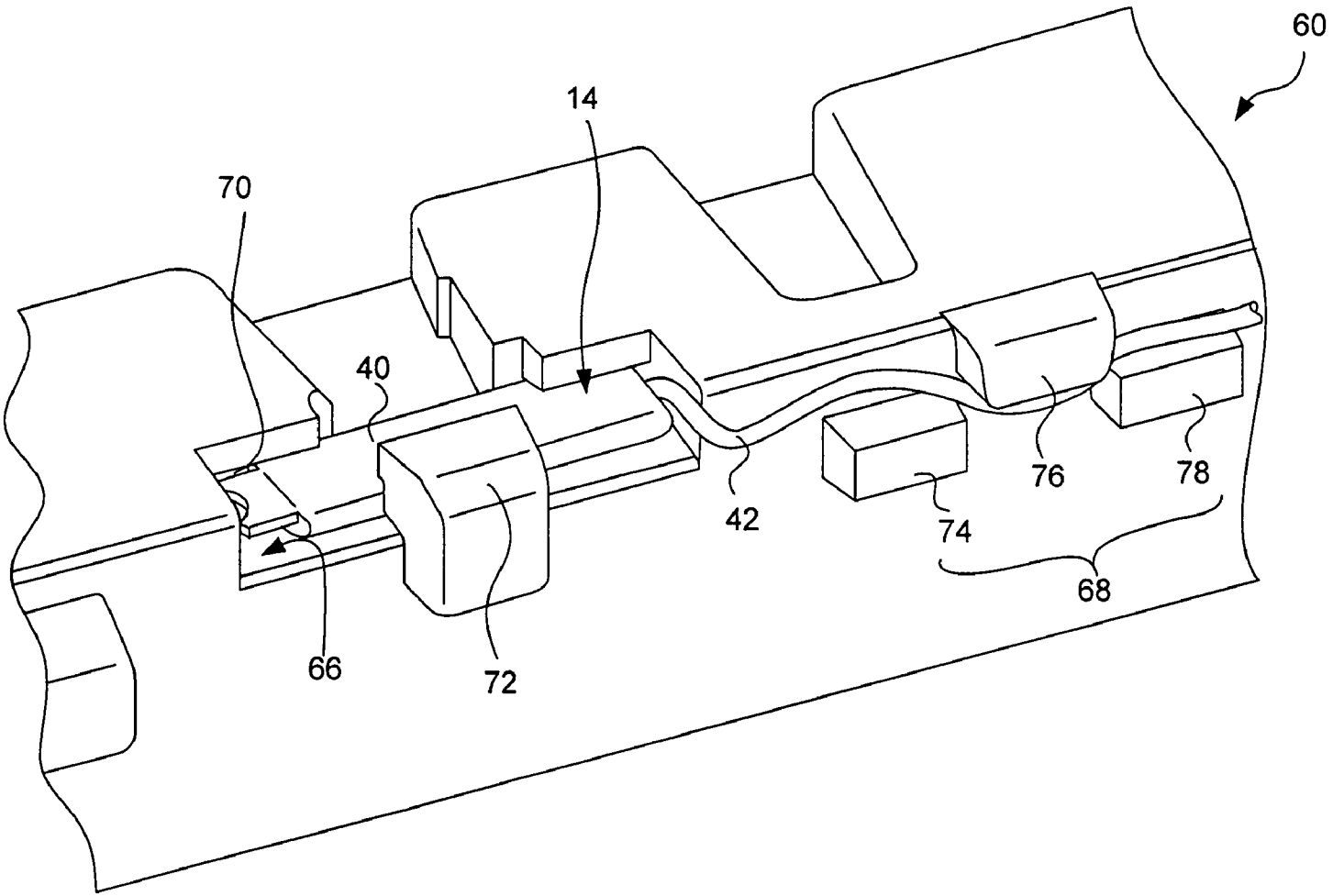
FIG. 13 is a fragmentary perspective view of the energy absorbing portion of the bumper assembly showing the antenna positioned fully installed in the antenna receiving channel in accordance with the present invention.

With specific reference to FIGS. 10, 11, 12 and 13, the snap-fit arrangement and installation of the antenna 14 in the channel 66 of the energy absorbing portion 60 is now described. First, the body portion 40 of the antenna 14 is turned 90 degrees relative to a final installation orientation so that the thinnest dimension of the body portion 40 is in a vertical orientation relative to depicted orientation of the energy absorbing member 60, as shown in FIGS. 10 and 11. The body portion 40 is then lowered into the channel 66, as shown in FIGS. 10 and 12. The body portion 40 is then rotated 90 degrees with one edge of the body portion 40 such that the body portion 40 is inserted into the recesses 70. Meanwhile, the opposite edge of the body portion 40 contacts the protrusion 72, as indicated in phantom in FIG. 10. Continued rotation of the body portion 40 while the body portion 40 is pressed against the protrusion 72, causes the protrusion 72 elastically deforms slightly so that the body portion 40 snap-fits into the recess 73 of the protrusion 72. Thereafter, the protrusion 72 retains the body portion 40 in place within the recesses 70 and the channel 66, as shown in FIGS. 10 and 13. Hence, the body portion 40 of the antenna 14 snuggly fits in the channel 66 in the snap-fit arrangement.

With the body portion 40 installed with the snap-fit arrangement in the channel 66 of the energy absorbing portion 60, the cable portion 42 and connector portion 44 can easily be installed, as described below and shown in FIGS. 12, 13 and 14.

For example as shown in FIGS. 12 and 13, the cable portion 42 is inserted between the protrusions 74, 78 and 76. Specifically, the cable portion 42 extends above the protrusions 74 and 78 and below the protrusion 76. As shown in FIG. 14, the connector portion 44 is installed on the energy absorbing portion 60 by inserting the alignment protrusion 46 into the connector opening 80 and inserting the attachment protrusion 48 into the connector opening 82. Since the attachment protrusion 48 has a conical shape that is larger than the connector opening 82, the attachment protrusion 48 must be forced into the connector opening 82. Consequently, the recess 52 on the attachment protrusion 48 contacts the surfaces that define the connector opening 82 and is retained in position, as shown in FIG. 14. With the connector portion 44 fixed to the energy absorbing portion 60, a signal transmitting connection can be made to the controller 30 via the connector plug opening 50 in a conventional manner.

Referring now to FIG. 7, the cover portion 62 is now described in greater detail. The cover portion 62 is basically a flexible fascia that is preferably made of a resilient, pliable material such as a plastic material, a polymer material or rubber-like material. The cover portion 62 is shaped and dimensioned to overly the energy absorbing portion 60, and preferably blend in with the aesthetics and engineering features of the vehicle 10. The cover portion 62 attaches to either or both the rear of the vehicle 10 and the energy absorbing portion 60 in a conventional manner. Preferably, the cover portion 62 is attached to the vehicle 10 and/or the energy absorbing portion 60 by fasteners (not shown).

The various devices and mechanisms of the vehicle 10 are conventional components that are well known in the art. Since vehicle devices and mechanisms are well known in the art, these structures will not be discussed or illustrated in detail herein. Rather, it will be apparent to those skilled in the art from this disclosure that the components can be any type of structure and/or programming that can be used to carry out the present invention.

GENERAL INTERPRETATION OF TERMS

As used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A vehicle security system comprising;

a bumper assembly including an energy absorbing portion and a cover portion overlying the energy absorbing portion, the energy absorbing portion having a concave channel formed on an outer surface of the energy absorbing portion, the concave channel being at least partially defined by an elongated access opening in the energy absorbing portion and a recessed bottom surface that is spaced inwardly of the outer surface of the energy absorbing portion;

an antenna supported within the channel of the energy absorbing portion spaced inwardly of the outer surface of the energy absorbing portion that defines the elongated access opening and covered by the cover portion of the bumper assembly such that the antenna is spaced apart from an inner surface of the cover portion; and a controller electrically connected to the antenna to process a signal within a prescribed proximity of the antenna.

2. The vehicle security system as set forth in claim 1, wherein the channel is integrally formed with a snap-fit retaining arrangement that is configured to retain the antenna via a snap-fit.

3. The vehicle security system as set forth in claim 2, wherein the energy absorbing portion is made of a one-piece foam material.

4. The vehicle security system as set forth in claim 2, wherein the snap-fit retaining arrangement includes a recessed section adjacent to the channel configured and dimensioned to retain the antenna within the channel.

5. The vehicle security system as set forth in claim 4, wherein the snap-fit retaining arrangement includes a protrusion formed with a recess configured and dimensioned to retain the antenna within the channel and the recessed section.

6. The vehicle security system as set forth in claim 1, wherein the energy absorbing portion is integrally formed with a cable retaining arrangement adjacent to the channel that is configured to retain a cable of the antenna to the energy absorbing member.

7. The vehicle security system as set forth in claim 1, wherein the energy absorbing portion is made of a one-piece foam material.

8. The vehicle security system as set forth in claim 1 wherein the energy absorbing portion overall has a first length and the channel overall has a second length such that the second length is less than the first length.

9. The vehicle security system as set forth in claim 8 wherein the second length is less than twenty percent of the first length.

10. The vehicle security system as set forth in claim 1 wherein the antenna is selectively removable from the channel.

11. A vehicle security system comprising:

a bumper assembly including an energy absorbing portion and a cover portion overlying the energy absorbing portion:

an antenna supported by the energy absorbing portion and covered by the cover portion of the bumper assembly; and a controller electrically connected to the antenna to process a signal within a prescribed proximity of the antenna, the channel being integrally formed with a snap-fit retaining arrangement that is configured to retain the antenna via a snap-fit, the snap-fit retaining arrangement including a recessed section adjacent to the channel configured and dimensioned to retain the antenna within the channel, the snap-fit retaining arrangement also including a protrusion formed with a recess configured and dimensioned to retain the antenna within the channel and the recessed section, the protrusion and the recessed section being located on opposite sides of the channel.

12. A vehicle security system comprising a bumper assembly including an energy absorbing portion and a cover portion overlying the energy absorbing portion;

an antenna supported by the energy absorbing portion and covered by the cover portion of the bumper assembly; and a controller electrically connected to the antenna to process a signal within a prescribed proximity of the antenna, the energy absorbing portion being integrally formed with a cable retaining arrangement adjacent to the channel that is configured to retain a cable of the antenna to the energy absorbing portion, and the cable retaining arrangement comprises a plurality of protrusions extending from the energy absorbing portion in an arrangement to retain the cable of the antenna in a longitudinal direction of the energy absorbing portion.

13. A vehicle bumper comprising:

an energy absorbing portion including a channel that is dimensioned and configured to receive an antenna; and a cover portion arranged and configured to cover the energy absorbing portion and conceal the channel, the channel being integrally formed with a snap-fit retaining arrangement that is configured to retain the antenna via a snap-fit.

14. The vehicle bumper assembly as set forth in claim 13, wherein the energy absorbing portion is made of a one-piece foam material.

15. The vehicle bumper assembly as set forth in claim 13, wherein the snap-fit retaining arrangement includes a recessed section adjacent to the channel configured and dimensioned to retain the antenna within the channel.

16. The vehicle bumper assembly as set forth in claim 15, wherein the snap-fit retaining arrangement includes a protrusion formed with a recess configured and dimensioned to retain the antenna within the channel and the recessed section.

17. The vehicle bumper assembly as set forth in claim 13, wherein the energy absorbing portion is integrally formed with a cable retaining arrangement adjacent to the channel that is configured to retain a cable of the antenna to the energy absorbing member.

18. The vehicle bumper assembly as set forth in claim 13, wherein the energy absorbing portion is made of a one-piece foam material.

19. The vehicle bumper assembly as set forth in claim 13 the energy absorbing portion overall has a first length and the channel overall has an second length such that the second length is less than the first length.

20. The vehicle security system as set forth in claim 19 wherein the second length is less than twenty percent of the first length.

21. The vehicle bumper assembly as set forth in claim 19 the channel is located in a mid-portion of the energy absorbing portion relative to the overall length of the energy absorbing portion.

22. The vehicle bumper assembly as set forth in claim 13 the antenna is selectively removable from the channel.

23. A vehicle bumper comprising:

an energy absorbing portion including a channel that is dimensioned and configured to receive an antenna, the channel being integrally formed with a snap-fit retaining arrangement that is configured to retain the antenna via a snap-fit, the snap-fit retaining arrangement including a recessed section adjacent to the channel configured and dimensioned to retain the antenna within the channel, the snap-fit retaining arrangement including a protrusion formed with a recess configured and dimensioned to retain the antenna within the channel and the recessed section, the protrusion and the recessed section being located on opposite sides of the channel; and a cover portion arranged and configured to cover the energy absorbing portion and conceal the channel.

24. A vehicle bumper comprising:

an energy absorbing portion including a channel that is dimensioned and configured to receive an antenna, the energy absorbing portion being integrally formed with a cable retaining arrangement adjacent to the channel that is configured to retain a cable of the antenna to the energy absorbing portion, the cable retaining arrangement comprising a plurality of protrusions extending from the energy absorbing portion in an arrangement to retain the cable of the antenna in a longitudinal direction of the energy absorbing portion; and a cover portion arranged and configured to cover the energy absorbing portion and conceal the channel.

25. An antenna support structure comprising:

an energy absorbing foam member having an outer surface formed with a concaved channel recessed from the outer surface, the concave channel being at least partially defined by an elongated access opening in the energy absorbing foam member and a recessed bottom surface that is spaced inwardly of the outer surface of the energy absorbing foam member, the channel being configured and dimensioned to receive an antenna; and a cover portion arranged and configured to cover the energy absorbing foam member and conceal the channel.

26. The antenna support structure as set forth in claim 25, wherein the channel is integrally formed with a snap-fit retaining arrangement that is configured to retain the antenna via a snap-fit.

27. The antenna support structure as set forth in claim 26, wherein the energy absorbing foam member is made of a one-piece foam material.

28. The antenna support structure as set forth in claim 26, wherein the snap-fit retaining arrangement includes a recessed section adjacent to the channel configured and dimensioned to retain the antenna within the channel.

29. The antenna support structure as set forth in claim 28, wherein the snap-fit retaining arrangement includes a protrusion formed with a recess configured and dimensioned to retain the antenna within the channel and the recessed section.

30. The antenna support structure as set forth in claim 25, wherein the energy absorbing foam member is integrally formed with a cable retaining arrangement adjacent to the channel that is configured to retain a cable of the antenna to the energy absorbing foam member.

31. The antenna support structure as set forth in claim 25, wherein the energy absorbing foam member is made of a one-piece foam material.

32. The antenna support structure as set forth in claim 25, wherein the energy absorbing foam member overall has a first length and the channel overall has an second length such that the second length is less than the first length.

33. The vehicle security system as set forth in claim 32 wherein the second length is less than twenty percent of the first length.

34. The antenna support structure as set forth in claim 32, wherein the channel is located in a mid-portion of the energy absorbing foam member relative to the overall length of the energy absorbing foam member.

35. The vehicle bumper assembly as set forth in claim 25 the antenna is selectively removable from the channel.

36. An antenna support structure comprising:

an energy absorbing foam member having a channel formed on a surface thereof configured and dimensioned to receive an antenna, the channel being integrally formed with a snap-fit retaining arrangement that is configured to retain the antenna via a snap-fit, the snap-fit retaining arrangement including a recessed section adjacent to the channel configured and dimensioned to retain the antenna within the channel, the snap-fit retaining arrangement also including a protrusion formed with a recess configured and dimensioned to retain the antenna within the channel and the recessed section, the protrusion and the recessed section being located on opposite sides of the channel; and a cover portion arranged and configured to cover the energy absorbing foam member and conceal the channel.

37. An antenna support structure comprising:

an energy absorbing foam member having a channel formed on a surface thereof configured and dimensioned to receive an antenna, the energy absorbing foam member being integrally formed with a cable retaining arrangement adjacent to the channel that is configured to retain a cable of the antenna to the energy absorbing foam member, the cable retaining arrangement comprising a plurality of protrusions extending from the energy absorbing foam member in an arrangement to retain the cable of the antenna in a longitudinal direction of the energy absorbing foam member; and a cover portion arranged and configured to cover the energy absorbing foam member and conceal the channel.

* * * * *